United States Patent [19]

Chen

[11] Patent Number: 4,984,925

[45] Date of Patent: Jan. 15, 1991

[54] STRUCTURE OF BINDING CLIP

[76] Inventor: Alan Chen, No. 52, Lane 136, Sanmin Rd., Taipei, Taiwan

[21] Appl. No.: 461,639

[22] Filed: Jan. 9, 1990

[51] Int. Cl.[5] ..... B42F 3/00

[52] U.S. Cl. ..... 402/8; 402/61; 402/64; 402/69

[58] Field of Search ..... 402/8, 13, 14, 15, 60, 402/61, 64, 68, 69

[56] References Cited

U.S. PATENT DOCUMENTS

| | | | |
|---|---|---|---|
| 1,051,089 | 1/1913 | David | 402/61 |
| 1,745,911 | 2/1930 | Proudfit et al. | 402/69 |
| 1,780,835 | 11/1930 | Mortensen | 402/64 |
| 2,023,156 | 12/1935 | Unger | 402/61 |
| 2,120,659 | 6/1938 | Wedge | 402/60 |
| 4,302,123 | 11/1981 | Dengler et al. | 402/64 |
| 4,305,675 | 12/1981 | Jacinto | 402/61 |
| 4,693,626 | 9/1987 | Ferreira-Godinho | 402/68 |

FOREIGN PATENT DOCUMENTS

| | | | |
|---|---|---|---|
| 2603001 | 2/1988 | France | 402/68 |
| 8500145 | 1/1985 | World Int. Prop. O. | 402/80 |

*Primary Examiner*—Paul A. Bell
*Assistant Examiner*—Hwei-Siu Payer
*Attorney, Agent, or Firm*—Asian Pacific Int'l Patent and Trademark Office

[57] ABSTRACT

An improvement in binding clip, which includes two symmetric clamping elements pivoted with two positioning plates mounted with two dove-tail slide blocks mounted thereon, and sheets of paper retained therein between the two symmetric clamping elements, whereby the amount of the sheets of paper can be flexibly increased or reduced according to requirement, and whereby the clampng elements each has two interconnected elastic strips to define a clearance with its back wall portion for mounting a cover page. Therefore, the assembly can be conveniently set up without the use of any working tool, functional flexibility can be for choice and low manufacturing cost can be achieved.

4 Claims, 6 Drawing Sheets

STRUCTURE OF BINDING CLIP

BACKGROUND OF THE INVENTION

The present invention is related to a binding clip and more particularly to the one which is convenient for use in binding sheets of paper together, does not interfere with the writing of the hand on the paper secured thereto, and can be flexibly adjusted according to the amount of sheets of paper mounted or releasably attached with a cover page to protect its inner sheets of paper.

Conventionally, there are various methods to hold sheets of paper together. Although methods may vary with one another, they can be inducted into two types, i.e. a fixed type and a non-fixed type. The fixed type is to permanently bind up sheets of paper with cover pages together, for example, in bookbinding or album manufacturing. If sheets of paper are bound into a book through fixed type binding procedure, the number of inner pages of such a book can not be flexibly changed. The non-fixed type, i.e. the loose-leaf type is to use a clip or the like to hold sheets of paper together. FIG. 1 illustrates a conventional paper file for holding sheets of paper together. As illustrated, a clip file includes a holder (1) made of rigid carton paper or plastic sheet having internally mounted hereon a clip generally comprised of two flexible metal strings or the like (2), a pressure plate (3), and two slides (30). When certain amount of sheets of paper are mounted on such a clip file, the sheets of paper may not be firmly retained in position. When the sheets are frequently turned over, they may be easily split off. FIG. 2 illustrates another conventional paper file, which comprises a clip (4) having two snap catches (40) thereon at its both ends. The two snap catches (40) each is comprised of two parts releasably engaged together to form a closed ring. This type of paper file is more convenient to operate in holding sheets of paper. However, the snap catches (40) are space consuming and may obstruct one's hands during writing. In the foregoing two different paper files, the clip (4) or the flexible metal strings (2) are not detachable, they are fixedly attached to the cover sheet of a file during manufacturing process.

SUMMARY OF THE INVENTION

The main object of the present invention is to provide a binding clip for holding sheets of paper together, which is easy to assemble, convenient to bind up sheet of paper, practical in use to firmly secure sheets of paper mounted thereon and can be flexibly arranged for different purpose according to requirement.

Another object of the present invention is to provide a binding clip for holding sheets paper together, which can be independently used as a paper clip or releasably attached with a cover page to protect and decorate the sheets of paper received therein.

Still another object of the present invention is to provide a binding clip for holding sheets paper together which is convenient for writing or for turning the sheets of paper secured thereto, and is collapsible and easy to build up, and further, the amount of sheets of paper received therein can be flexibly increased or reduced according to requirement.

The present invention will be fully understood from the following detailed description of the present invention, with reference made to the annexed drawings, in which:

Figure 1:
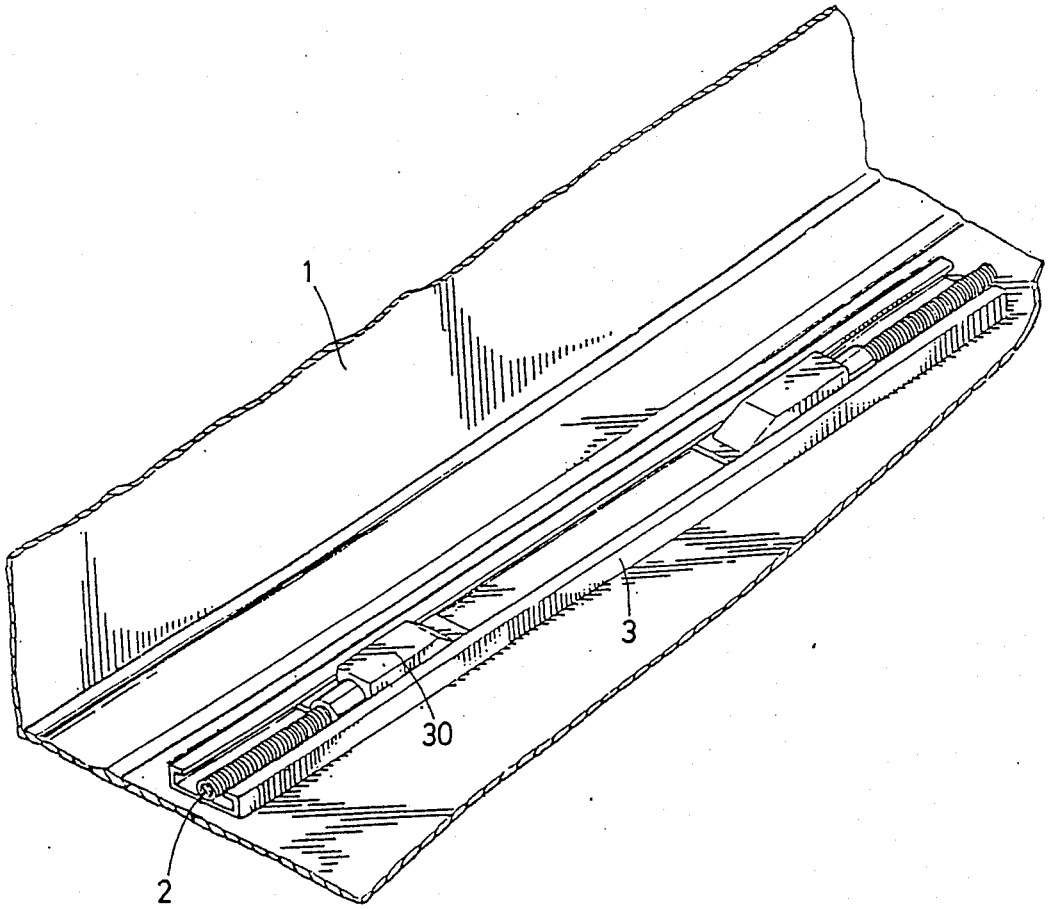
FIG.1 (Prior Art)
FIG. 1 is a schematic structural view of a conventional paper file.
Figure 2:
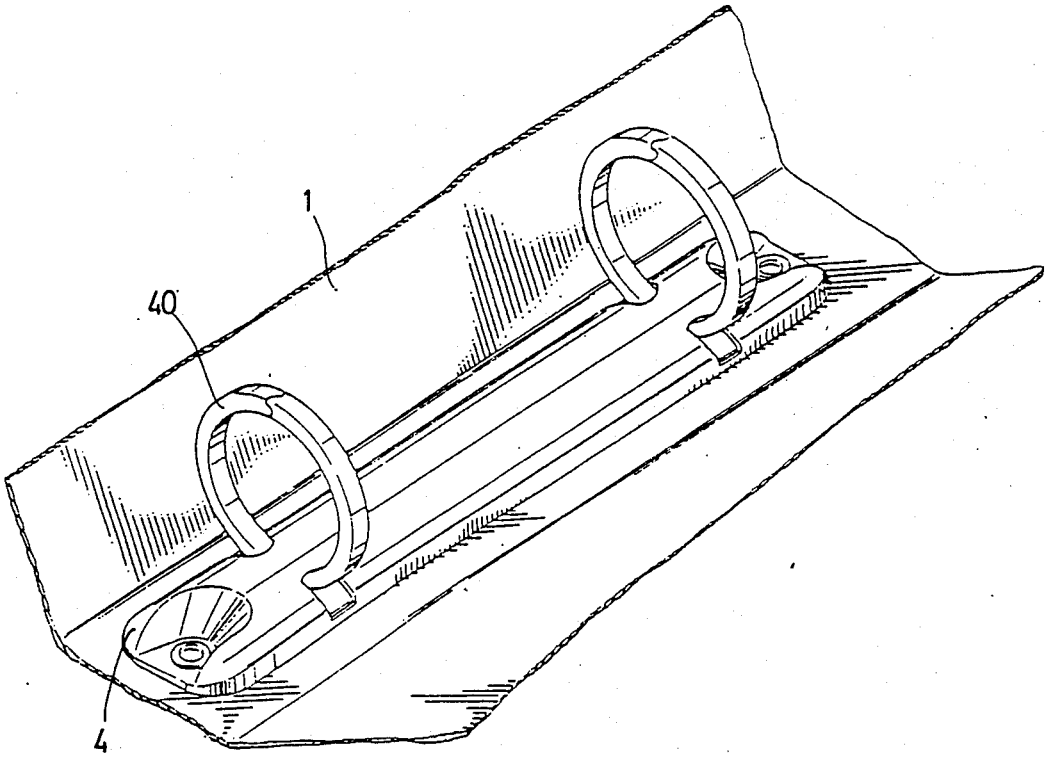
FIG. 2 (Prior Art)
FIG. 2 is a schematic structural view of another type of conventional paper file.
Figure 3:
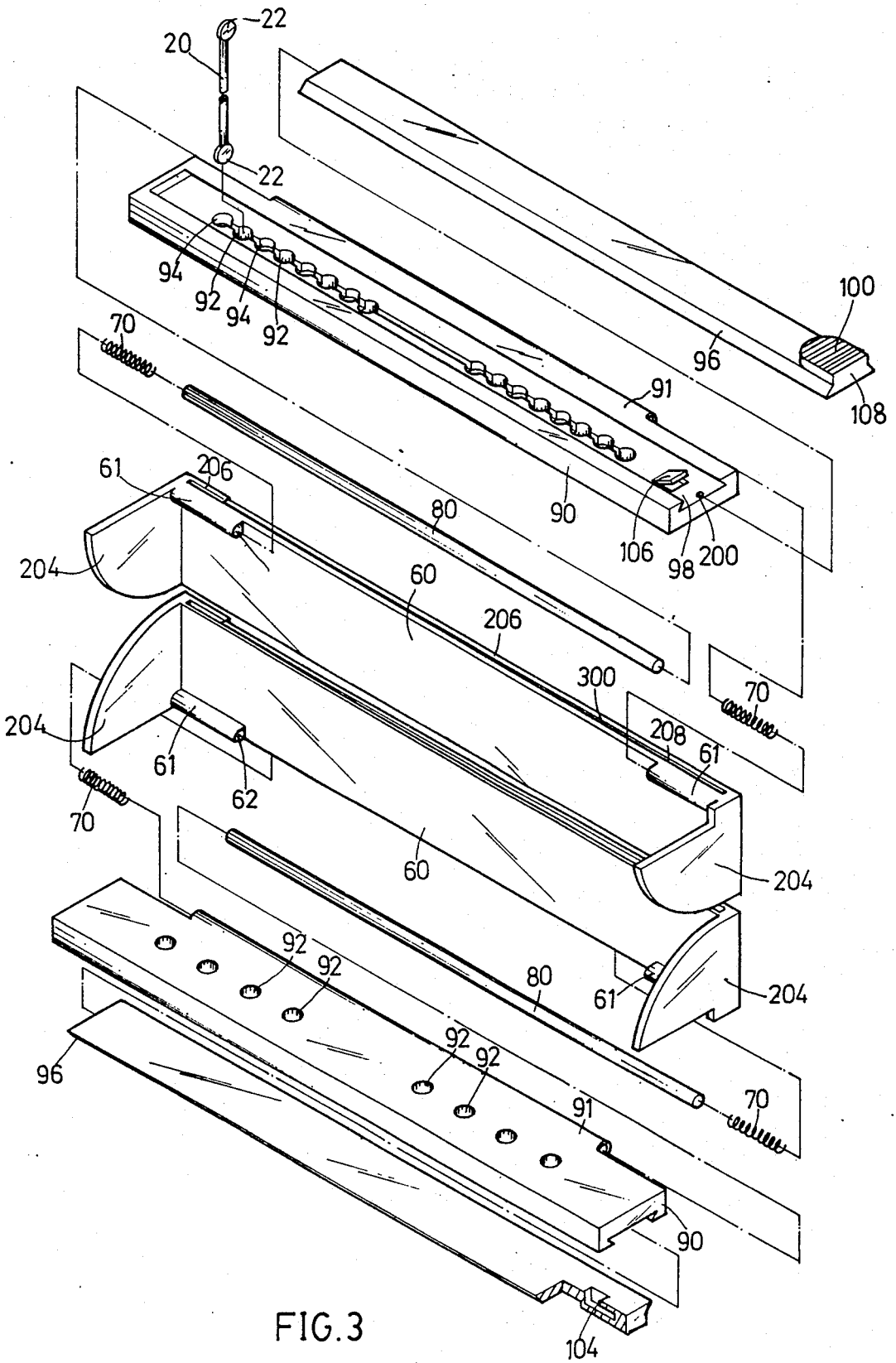
FIG. 3 is a perspective exploded view of a binding clip constructed according to the present invention.

DETAILED DESCRIPTION OF THE PREFERRED EMBODIMENTS:

Referring to FIG. 3, there is an embodiment of binding clip in accordance with the present invention and generally comprised of two clamping elements (60). The two clamping elements (60) are symmetrical in structure, having each a pair of unitary axle housings (61) disposed laterally at its both ends. The unitary axle housings (61) each has a blind boring bore (62) with a spring (70) inserted therein. An axle (80) is respectively mounted on each clamping element (60) to secure a positioning plate (90) thereto, which positioning plate (90) has an axle housing (91) at its lateral side for insertion therein of an axle (80). As illustrated, an axle (80) has its one end inserted into the blind boring bore (62) of either axle housing (61) of either clamping element (60) permitting mounting thereon of a positioning plate (90) through its axle housing (91). After mounting of a positioning plate (90), the other end of such an axle (80) is inserted into the blind boring bore (62) of the other axle housing (61) of such a clamping element (60). After two positioning plates (90) are respectively secured to the two clamping elements (60) by two axles (80), a certain amount of loose-leaf sheets can be placed in the two clamping elements (60) and firmly secured therein by a plurality of wire rods (20). The two positioning plates (90) each also comprises a dove-tail slide (98) having thereon a plurality of positioning holes (92), a plurality of retaining holes (94) by the positioning holes (92), and a groove between the positioning holes (92) and the retaining holes (94). The wire rods (20) each has two opposite snap members (22) at its both ends and is inserted through one positioning hole (92) of either positioning plate (90) into a corresponding positioning hole (92) on the opposite positioning plate (90) with its both snap members (22) respectively seated in retaining holes (94) on the two positioning plate (90) by the positioning holes (92). After mounting of loose-leaf sheets, a dove-tail slide block (96) each is respectively inserted into the dove-tail slide (98) of each positioning plate (90) to cover the retaining holes (94). After either dove-tail slide block (96) is removed, the wire rods (20) can be conveniently released, and loose-leaf sheets can be removed therefrom or added thereto.

Figure 5:
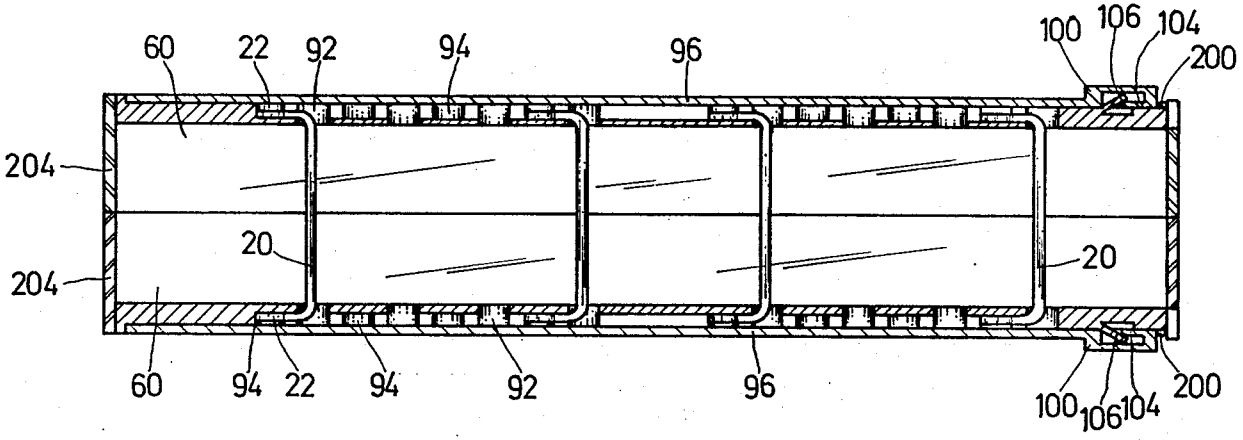
FIG. 5 os a secional view taken on line 5—15 of FIG. 4.

Referring to FIG. 5, each slide block (96) comprises a thumb knob (100) at its one end on its upper side, and a female fastening member (104) at its bottom side right below its thumb knob (100). When a slide block (96) is pushed forward through its thumb knob (100) in the dove-tail slide (98) of either positioning plate (90), its female fastening member (104) will be engaged with a male fastening member (106) on the dove-tail slide (98) of such a positioning plate (90). When the female fastening member (104) of such slide block (96) is stopped by the male fastening member (106) of such positioning plate (90), such slide block (96) has its one side end (108) stopped at a stopper (200) on the dove-tail slide (98) of such positioning plate (90) to become firmly secured thereto.

Figure 4:
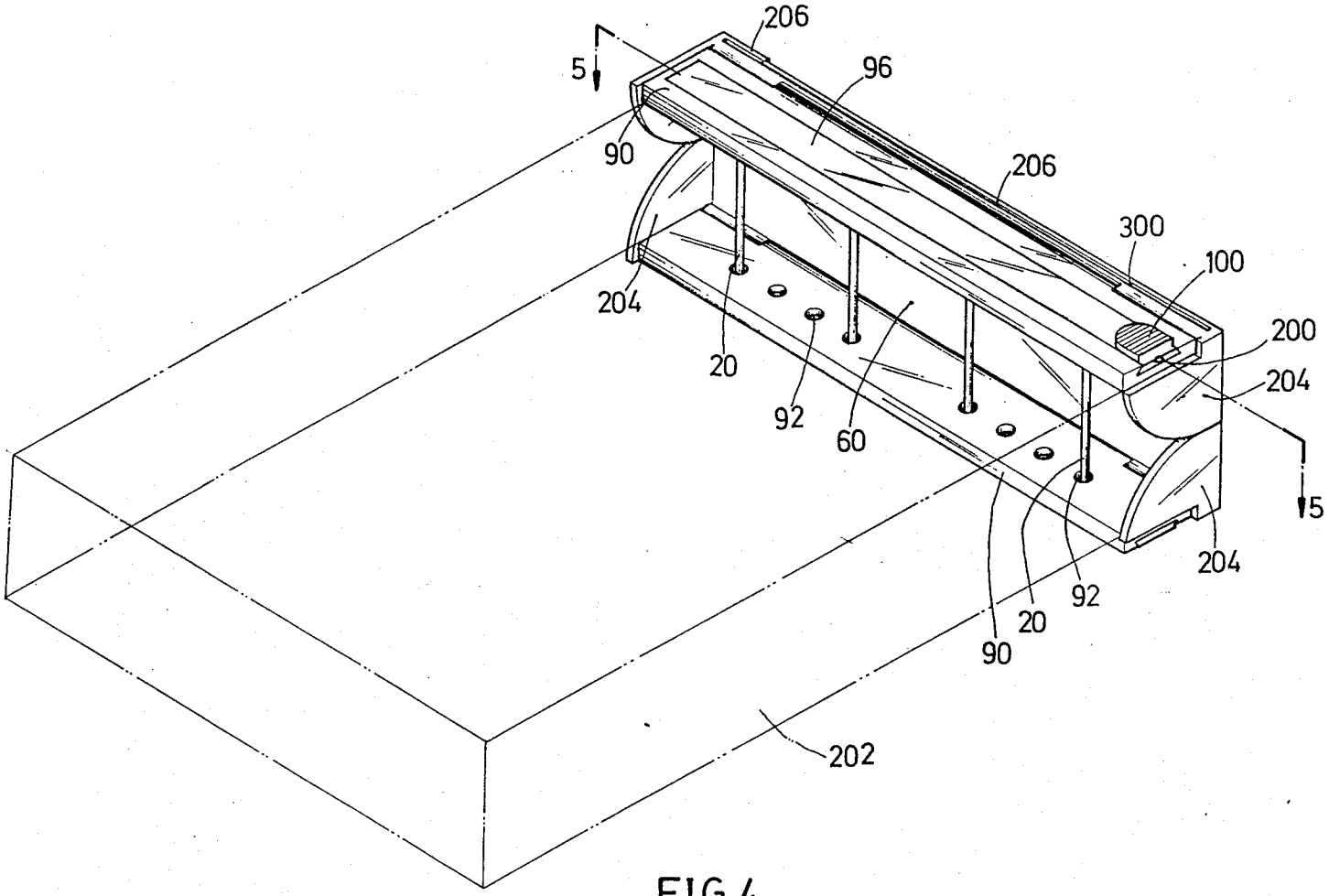
FIG. 4 is a perspective assembly view of a binding clip embodying the present invention.

Referring to FIG. 4, a certain amount of loose-leaf sheets (202) are bound in the two clamping elements (60) and bilaterally stopped by curved bumpers (204) which are respectively connected to the two clamping elements (60) at their both ends. The curved bumpers (204) serve to protect the loose-leaf sheets (202) received therein and keep them in order. If to add additional loose-leaf sheets or to pick up some loose-leaf sheet from the binding clip, push the upper dove-tail slide block (96) away from the corresponding dove-tail slide (98) through its thumb knob (100) and remove the wire rods (20) from the two positioning plates (90). Thus, loose-leaf sheets can be added to or removed from the binding clip.

Figure 6:
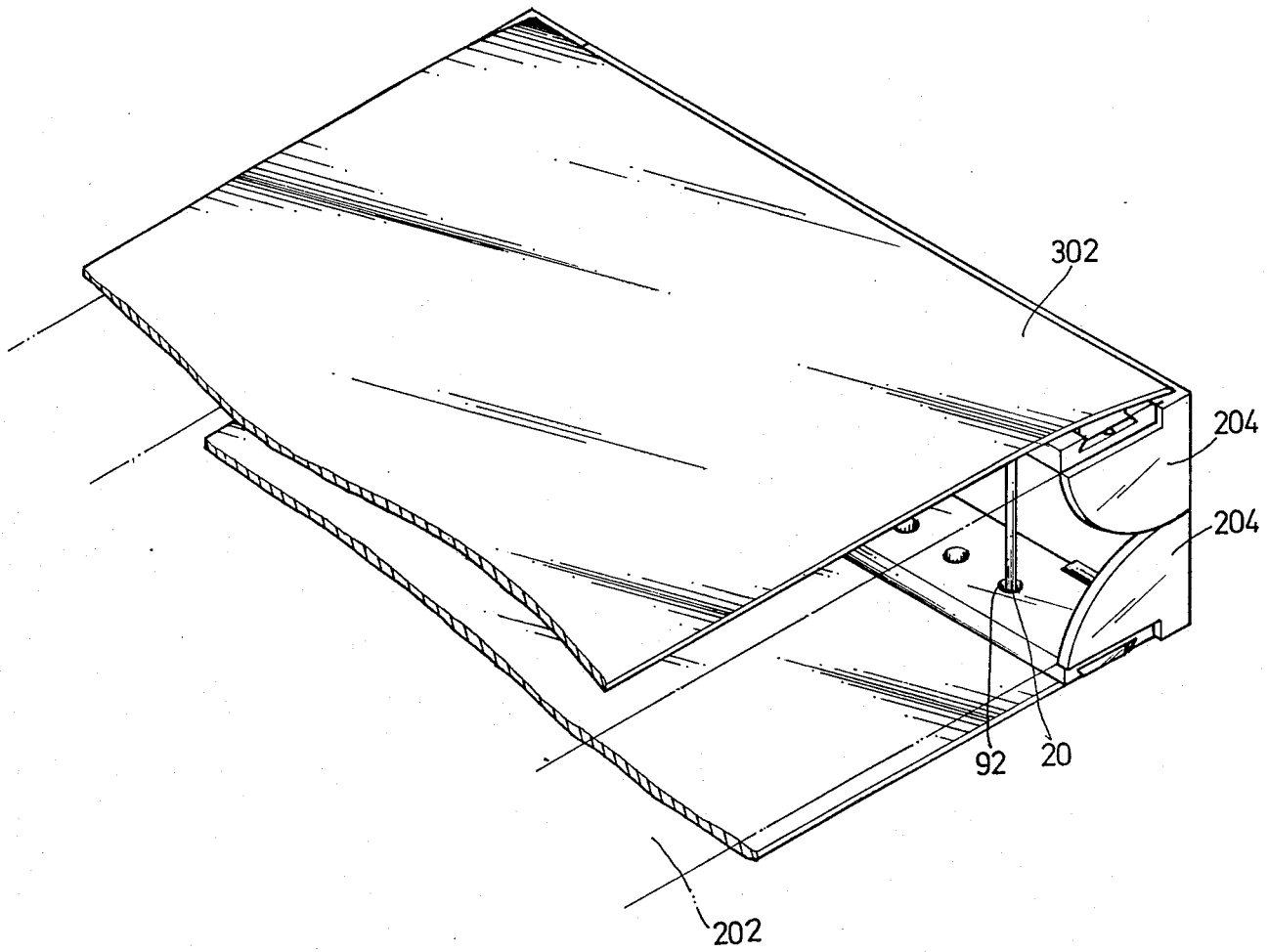
FIG. 6 is a perspective fragmentary view, illustrating the mount of cover pages on a binding clip of the present invention.

Referring to FIGS. 3 and 6, each clamping element (60) also comprises two elastic plates (206) respectively extending from its both ends, which two elastic plates (206) have their front ends respectively interconnected to define a gap (300) with a back wall portion (208) of the clamping element (60). A cover page (302) may be inserted in the gap (300) of each clamping element and firmly retained by the two elastic plates (206) of each clamping element (60) to protect the inner loose-leaf sheets (202).

What is claimed is:

1. A binding clip for binding up loose-leaf sheets, including:

a plurality of compression springs;

a plurality of wire rods, each having two opposite snap members at its both ends;

a plurality of dove-tail slide blocks, each having a thumb knob at its one end on its upper side, and a female fastening member at its bottom side right below said thumb knob;

a plurality of positioning plates, each having thereon a dove-tail slide for sliding therein of either one of said slide blocks, and an axle housing at its one lateral side, said dove-tail slide having thereon a male fastening member for engaging with said female fastening member of either one of said dove-tail slide blocks, a plurality of through-holes, and a plurality of blind holes, said through-holes and said blind holes being interjected with one another;

one set of symmetric clamping elements, each having two curved bumpers vertically disposed at its both ends and a pair of axle housing inward extending from said two curved bumpers; and a plurality of axles;

wherein said compression springs are respectively inserted into the axle housings of said clamping elements; said axles are respectively inserted through the axle housings of said positioning plates and have their both ends respectively set in the axle housings of said clamping elements to secure said positioning plates to said clamping elements respectively; said wire rods are respectively inserted through the through-holes of said positioning plates with their snap members alternatively set in the blind holes therof so as to secure loose-leaf sheets to said clamping elements; said dove-tail slide blocks are respectively inserted in the dove-tail slides of said positioning plates.

2. A binding clip as claimed in claim 1, wherein a stop member each is made on said dove-tail slides of said two positioning plates to stop said dove-tail slide blocks from sliding.

3. A binding clip as claimed in claim 1, wherein said set of symmetric clamping elements are unitarily shape molded.

4. A binding clip as claimed in claim 1, wherein said set of symmetric clamping elements each comprises two elastic plates respectively extending therefrom with their front ends respectively interconnected together to define a clearance with a back wall portion thereof.

* * * * *